US012577950B2

(12) United States Patent
Wehrenberg et al.

(10) Patent No.: US 12,577,950 B2
(45) Date of Patent: Mar. 17, 2026

(54) COATING LAYER HAVING A CONFORMING MATERIAL FOR A COMPRESSOR AND METHOD OF USING THE SAME

(71) Applicant: TRANE INTERNATIONAL INC., Davidson, NC (US)

(72) Inventors: Christopher A. Wehrenberg, La Crosse, WI (US); Joseph E. Ziolkowski, Jr., Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 61 days.

(21) Appl. No.: 18/627,103

(22) Filed: Apr. 4, 2024

(65) Prior Publication Data

US 2025/0314251 A1 Oct. 9, 2025

(51) Int. Cl.
*F04C 15/00* (2006.01)
*F04C 2/02* (2006.01)
(Continued)

(52) U.S. Cl.
CPC ..... *F04C 15/0003* (2013.01); *F04C 2/025* (2013.01); *F04C 2/16* (2013.01); *F25B 31/026* (2013.01); *F04C 2240/30* (2013.01)

(58) Field of Classification Search
CPC ..... F04C 15/0003; F04C 2/025; F04C 2/16; F04C 2240/30; F04C 18/16;
(Continued)

(56) References Cited

U.S. PATENT DOCUMENTS 5,356,277 A 10/1994 Yamaguchi et al.
5,531,574 A 7/1996 Honma
(Continued)

FOREIGN PATENT DOCUMENTS

CN 105604933 A * 5/2016
CN 106762631 A 5/2017
(Continued)

OTHER PUBLICATIONS

Extended European Search Report, European Patent Application No. 25168337.1, Jul. 22, 2025 (9 pages).

*Primary Examiner* — Emmanuel E Duke
(74) *Attorney, Agent, or Firm* — HSML P.C.

(57) ABSTRACT

A method, HVACR system, and positive displacement compressor that includes a compressor housing and a rotating component and at least one second component. Each of the rotating component and the at least one second component have a contacting surface that define a meshing location between the rotating component and the at least one second component to form a compression chamber. Additionally, a coating layer is provided on the contacting surface of at least one of the rotating component or the at least one second component, in which the coating layer includes at least a first applied layer and a second applied layer. The first layer and the second layer are separate layers and both the first layer and the second layer include a conforming material, in which the conforming material in the first applied layer has a different particle size than the conforming material in the second applied layer.

19 Claims, 8 Drawing Sheets

(51) Int. Cl.
*F04C 2/16* (2006.01)
*F25B 31/02* (2006.01)

(58) Field of Classification Search
CPC F04C 18/0207; F04C 2230/91; F25B 31/026; F05C 2251/14
See application file for complete search history.

(56) References Cited

U.S. PATENT DOCUMENTS

| | | | |
|---|---|---|---|
| 6,595,763 | B2 | 7/2003 | Wagner et al. |
| 6,887,052 | B1 | 5/2005 | Bush et al. |
| 7,179,067 | B2 | 2/2007 | Bush et al. |
| 9,605,677 | B2 | 3/2017 | Heidecker et al. |
| 9,885,347 | B2 | 2/2018 | Lachey et al. |
| 2007/0225177 | A1 | 9/2007 | Murase et al. |
| 2009/0136747 | A1 | 5/2009 | Kikuchi |
| 2013/0247699 | A1 | 9/2013 | Nomura et al. |
| 2013/0296203 | A1 | 11/2013 | Ay et al. |

FOREIGN PATENT DOCUMENTS

| | | | | |
|---|---|---|---|---|
| CN | 216157894 | U | * | 4/2022 |
| EP | 2933488 | A1 | | 10/2015 |
| JP | 2003035284 | A | * | 2/2003 |

* cited by examiner

COATING LAYER HAVING A CONFORMING MATERIAL FOR A COMPRESSOR AND METHOD OF USING THE SAME

FIELD

This disclosure is directed to apparatuses and methods that include a compressor with a coating layer on lubricated and/or sealing surfaces, and in particular, a coating layer having a conforming material on a mating surface of the compressor to reduce or prevent compression leakage, e.g., leakage of working fluid through the compression chamber.

BACKGROUND

A lubricant, such as oil, may be used in compressors for heating, ventilation, air conditioning, and refrigeration (HVACR) systems for providing lubrication and, in some cases, for providing a sealing layer between mating surfaces, e.g., gap between orbiting scroll and fixed scroll or gap between male and female rotors, and/or a sealing surface, such as, a labyrinth seal. With increasing government regulations, e.g., U.S. Department of Energy (DOE), that are aimed at raising or increasing energy efficiency of processing equipment, such as compressors, there is a need to reduce compression leakage which penalizes energy efficiency, e.g., gap distances are too wide to allow a thin film of lubricant to seal the gap effectively such that some or a portion of the working fluid may pass through the gap which reduces the compression efficiency.

SUMMARY

This disclosure is directed to apparatuses and methods that include a compressor with a coating layer on lubricated and/or sealing surfaces, and in particular, a coating layer having a conforming material on a mating surface of the compressor to reduce or prevent compression leakage, e.g., leakage of working fluid through the compression chamber.

In an embodiment, a positive displacement compressor is provided. The positive displacement compressor includes a compressor housing, and a rotating component disposed within the compressor housing. The rotating component and at least one second component form a compression chamber to compress a working fluid. Each of the rotating component and the at least one second component have a contacting surface, the contacting surface of the rotating component and the contacting surface of the at least one second component define a meshing location between the rotating component and the at least one second component to form the compression chamber. Additionally, a coating layer is provided on the contacting surface of at least one of the rotating component or the at least one second component, wherein the coating layer comprises at least a first applied layer and a second applied layer, wherein the first applied layer and the second applied layer are separate layers and both the first applied layer and the second applied layer include a conforming material, wherein the conforming material in the first applied layer has a different particle size than the conforming material in the second applied layer such that a combination of the first applied layer and the second applied layer seal the contacting surface.

In another embodiment, a heating, ventilation, air conditioning, and refrigeration (HVACR) system is provided. The HVACR system includes a compressor; a condenser; an expander; and an evaporator. The compressor includes a compressor housing and a rotating component disposed within the compressor housing. The rotating component and at least one second component form a compression chamber to compress a working fluid. Each of the rotating component and the at least one second component have a contacting surface, the contacting surface of the rotating component and the contacting surface of the at least one second component define a meshing location between the rotating component and the at least one second component to form the compression chamber. Additionally, a coating layer is provided on the mating surface of at least one of the rotating component or the at least one second component, wherein the coating layer comprises at least a first applied layer and a second applied layer, wherein the first applied layer and the second applied layer are separate layers and both the first applied layer and the second applied layer include a conforming material, wherein the conforming material in the first applied layer has a different particle size than the conforming material in the second applied layer such that a combination of the first applied layer and the second applied layer seal the contacting surface.

In yet another embodiment, a method of manufacturing a positive displacement compressor with a conforming material on at least one contacting surface is provided. The method includes providing at least one rotating component or a second component that forms a compression chamber in a compressor housing for the positive displacement compressor, each of the rotating component or second component having a contacting surface, the contacting surface of the rotating component and the contacting surface of the second component defining a meshing location between the rotating component and the second component to form the compression chamber; coating a first coating layer on the contacting surface of at least one of the rotating component or the second component; coating a second coating layer on the contacting surface of the at least one of the rotating component or the second component, in which both the first coating layer and the second coating layer include a conforming material, in which the conforming material in the first coating layer has a different particle size than the conforming material in the second coating layer; and forming the compressor housing including the rotating component and the second component within the compressor housing, in which the at least one rotating component or the second component that form the compression chamber includes the first coating layer and the second coating layer such that a combination of the first coating layer and the second coating layer seal the contacting surface, in which the first coating layer and the second coating layer are separate layers.

BRIEF DESCRIPTION OF THE DRAWINGS

The accompanying drawings illustrate various embodiments of systems, methods, and embodiments of various other aspects of the disclosure. Any person with ordinary skill in the art will appreciate that the illustrated element boundaries (e.g. boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another, and vice versa. Non-limiting and non-exhaustive descriptions are described with reference to the following drawings. The components in the figures are not necessarily to scale, emphasis instead being placed upon illustrating principles. In the detailed description that follows, embodiments are described as illustrations only since various changes and modifications may become apparent to those skilled in the art from the following detailed description.

Like reference numbers represent like parts throughout.

DETAILED DESCRIPTION

Figure 1:
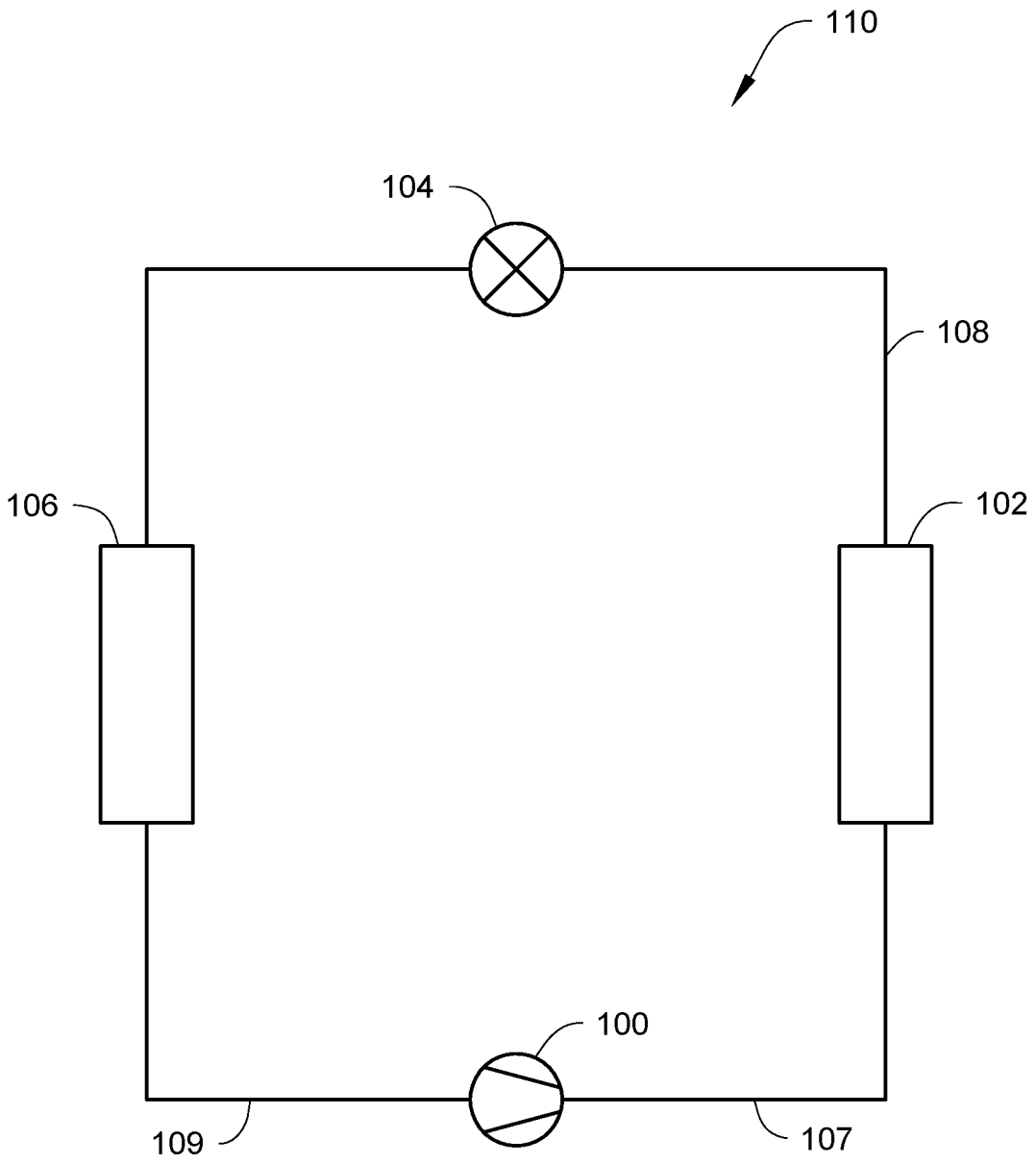
FIG. 1 shows a schematic diagram of an HVACR system according to an embodiment.

In the following detailed description, particular embodiments of the present disclosure are described herein with reference to the accompanying drawings, which form a part of the description. In this description, as well as in the drawings, like-referenced numbers represent elements that may perform the same, similar, or equivalent functions, unless context dictates otherwise. Furthermore, unless otherwise noted, the description of each successive drawing may reference features from one or more of the previous drawings to provide clearer context and a more substantive explanation of the current example embodiment. Still, the example embodiments described in the detailed description, drawings, and claims are not intended to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

It is to be understood that the disclosed embodiments are merely examples of the disclosure, which may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in virtually any appropriately detailed structure.

The scope of the disclosure should be determined by the appended claims and their legal equivalents, rather than by the examples given herein. For example, the steps recited in any method claims may be executed in any order and are not limited to the order presented in the claims. Moreover, no element is essential to the practice of the disclosure unless specifically described herein as "critical" or "essential."

It is understood that the term "at or about" as used herein is within +/−5% of the designated value.

This disclosure is directed to apparatuses and methods that include a compressor with a coating layer on lubricated and/or sealing surfaces, and in particular, a coating layer having a conforming material on a mating surface of the compressor to reduce or prevent compression leakage, e.g., leakage of working fluid through the compression chamber.

As government regulations, e.g., from the U.S. Department of Energy, are provided that are aimed at raising or increasing energy efficiency of processing equipment, such as compressors, there is a need to reduce compression leakage which penalizes energy efficiency. For example, in some cases, a gap distance between a mating surface and/or a sealing surface may be too large, e.g., a gap distance of between at or about 5 and at or about 100 microns, which may prevent a lubricant to seal the gap effectively such that some or a portion of the working fluid may pass through the gap, e.g., leakage of working fluid, which reduces the compression efficiency. The gaps or distance of the gap may be a result at least in part due to machining differences, machining variances, machining tolerances, and/or assembly error or variance, when manufacturing and/or assembling, when manufacturing the various parts or components of the compressor. Such compression leakage penalizes energy efficiency since the working fluid may pass through such gaps in the rotating assembly without being compressed and/or not allow the compressor to efficiently compress the working fluid. Since the cost to reduce the differences in machining processes, machining variances, machining tolerances, and/or during assembly may outweigh the expected benefit, there is a need to decrease this gap distance to improve the compressor efficiency and/or energy efficiency of the compressor in a cost effective and beneficial manner.

As such, the present disclosure is at least directed to providing a coating layer to control the gap distance and/or to hold the lubricant higher or above the machined surface to effectively seal the gap to improve compressor efficiency and/or energy efficiency. In some embodiments as disclosed herein, the coating layer may be used on mating and/or scaling surfaces for one or more components of the compressors, such as a positive displacement compressor, such that the coating layer and lubricant, such as oil, may be used to fill gaps between mating and/or sealing surfaces, e.g., the lubricant may be the final sealing component based on the thickness of the coating layer even for larger gap distances that are the results of the machining processes, machining variances, machining tolerances, and/or assembly error or variances. For example, the assembly error or variance may occur during placement of a lower main bearing relative to the upper main bearing, which is in the housing, which may tilt the crankshaft and drive positional error between the scrolls, e.g., the bearing positions, and in which the tilting of the crankshaft moves the orbiting scroll relative to the proper engagement of fixed scroll creating gap(s). It is appreciated that in some embodiments, the coating layer may be designed or otherwise configured to have a thickness that at least partially fills the gap between the mating and/or sealing surfaces to hold the lubricant at a higher level above the component surface to provide the necessary sealing which improves compression, e.g., sealing to prevent or mitigate working fluid leakage, and, thus, resulting in higher energy efficiency. In some embodiments, the coating layer may include a conformable material that may include crystal particles, which may be designed or configured to abate local high spots between mating components, which may avoid or prevent local high spots that may push the mating components apart causing gaps in the compression chamber that allows for working fluid, e.g., refrigerant, leakage.

Thus, a compressor is provided that: 1) has excellent compression, e.g., compression efficiency, even with the complexity of rotating parts, such as for spiral compression chambers for a scroll compressor, in which large gap distances that are results from the precision of machining and precision of assembly between mating and/or sealing surfaces may be reduced or mitigated; 2) includes a coating layer having a conforming material that has the requisite thickness and/or height and/or morphology to reduce and/or mitigate the gap distance between mating and/or sealing surfaces, which may improve compression; and 3) includes a coating layer that works with the chemistry of the working fluid, e.g., refrigerants, which may be corrosive and/or break down to form corrosive chemicals, and/or the lubricant, e.g., oil.

Further details of the apparatuses and methods that include a compressor with a coating layer on lubricated and/or sealing surfaces, and in particular, a coating layer having a conforming material on a mating surface of the compressor are discussed below.

FIG. 1 is a schematic diagram of an HVACR system 110, according to an embodiment. The HVACR system 110 includes a compressor 100, a condenser 102, an expander 104, and an evaporator 106.

The HVACR system 110 is an example that is modifiable to include additional components. For example, in an embodiment, the HVACR system 110 can include other components such as, but not limited to, an economizer heat exchanger, one or more flow control devices, a receiver tank, a dryer, one or more additional heat exchangers, or the like.

The HVACR system 110 is generally applicable in a variety of systems used to control an environmental condition (e.g., temperature, humidity, air quality, or the like) in a space (generally referred to as a conditioned space). Examples of such systems include, but are not limited to, residential, commercial, or industrial HVACR systems, transport refrigeration systems, or the like.

The HVACR system 110 includes the compressor 100, condenser 102, expander 104, and evaporator 106 fluidly connected via refrigerant lines 107, 108, and 109. In an embodiment, the refrigerant lines 107, 108, and 109 can alternatively be referred to as the refrigerant conduits 107, 108, and 109, or the like.

In an embodiment, the HVACR system 110 is configured to be a cooling system (e.g., an air conditioning system) capable of operating in a cooling mode. In an embodiment, the HVACR system 110 is configured to be a heat pump system that can operate in both a cooling mode and a heating/defrost mode.

The HVACR system 110 can operate according to generally known principles. The HVACR system 110 can be configured to heat or cool a process fluid (e.g., a heat transfer medium or fluid such as, but not limited to, water, air or the like), in which case the HVACR system 110 may be generally representative of an air conditioner or heat pump.

In operation, the compressor 100 compresses a working fluid (e.g., a heat transfer fluid such as a refrigerant or the like) from a relatively lower pressure gas (e.g., suction pressure) to a relatively higher-pressure gas (e.g., discharge pressure). In an embodiment, the compressor 100 can be a positive displacement compressor. In an embodiment, the positive displacement compressor can be a screw compressor, a scroll compressor, a reciprocating compressor, or the like.

The relatively higher-pressure gas is also at a relatively higher temperature, which is discharged from the compressor 100 and flows through refrigerant line 107 to the condenser 102. The working fluid flows through the condenser 102 and rejects heat to a process fluid (e.g., water, air, or the like), thereby cooling the working fluid. The cooled working fluid flows to the expander 104 via the refrigerant line 108. In an embodiment, the expander 104 may be any expansion device such as an expansion valve, expansion plate, expansion vessel, orifice, or the like, or other suitable types of expansion mechanisms. It is to be appreciated that the expander may be any type of expansion device used in the field for expanding a working fluid to cause the working fluid to decrease in temperature and/or pressure.

The expander 104 reduces the pressure of the working fluid. The working fluid flows to the evaporator 106 via the refrigerant line 108. The working fluid flows through the evaporator 106, where it absorbs heat from a process fluid (e.g., water, air, or the like), heating the working fluid. The heated working fluid then returns to the compressor 100 via the refrigerant line 109. The above-described process continues while the HVACR system is operating, for example, in a cooling mode (e.g., while the compressor 100 is enabled).

Figure 2:
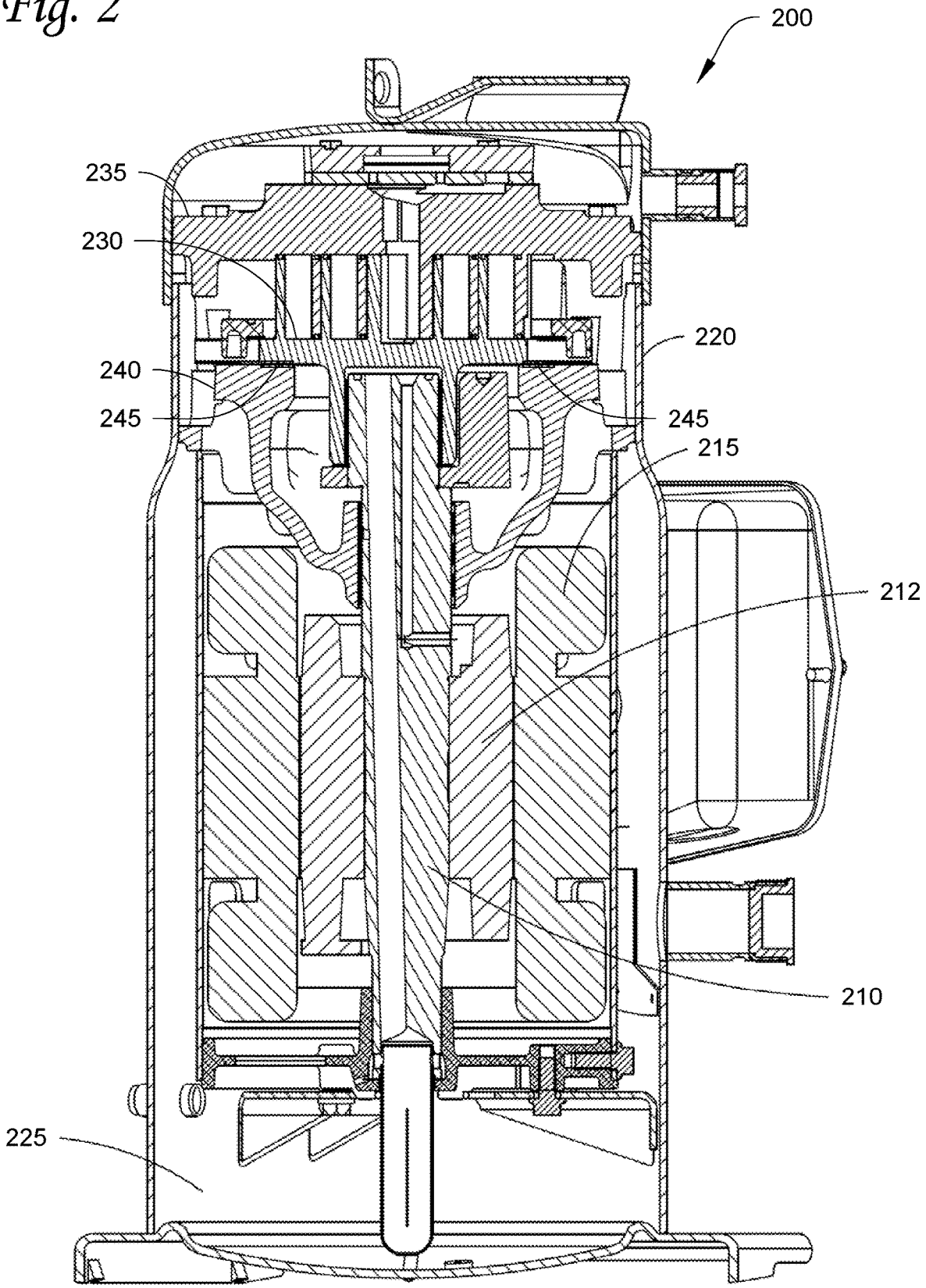
FIG. 2 shows a sectional view of a vertical, single-stage scroll compressor according to an embodiment.

FIG. 2 illustrates a scroll compressor according to an embodiment. It is to be appreciated that the embodiments as disclosed herein may be used with other types of compressors, such as, for example, other types of scroll compressors, a screw compressor, a reciprocating compressor and other suitable types of compressors, including hermetic compressors. The embodiments as disclosed herein are suitable for compressors having contacting and/or mating surfaces.

The scroll compressor 200 includes a housing 220. The crankshaft 210 is coupled to a rotor 212. The rotor 212 is surrounded by a stator 215. The crankshaft 210 is coupled to an orbiting scroll member 230 that is intermeshed with a fixed scroll member 235 to compress, for example, a working fluid of an HVACR system. The housing 220 also includes a lubricant sump 225 that may contain a lubricant.

The orbiting scroll member 230 is positioned vertically or near vertically in the orientation as shown in FIG. 2. In the vertical direction, the orbiting scroll member 230 is partially supported by a stationary supporting structure 240 of the housing 220. The orbiting scroll member 230 and the stationary supporting structure 240 are separated by a thrust bearing 245. In an embodiment, the stationary supporting structure 240 is a bearing housing.

In operation, the stator 215 and the rotor 212 can create a relative motion, which is transmitted to the crankshaft 210. The crankshaft 210 can then drive the orbiting scroll member 230 to intermesh with the fixed scroll member 235 and compress, for example, a working fluid of an HVACR system.

The thrust bearing 245 may withstand axial thrust loads in the vertical direction. The axial thrust load may be created by, for example, a weight of the orbital scroll member 230. The axial thrust load may also be created by, for example, a pressure differential between the scroll mechanism (e.g. orbiting scroll member 230) and sump 225 of the housing 220. The axial thrust load may increase friction between the crankshaft 210 and the thrust bearing 245, consequently causing wear of the thrust bearing 245. Further, wearing of the thrust bearing 245 may be created by sliding wear. More specifically, sliding wear can be created by adhesion, abrasion, or both.

Figure 3A:
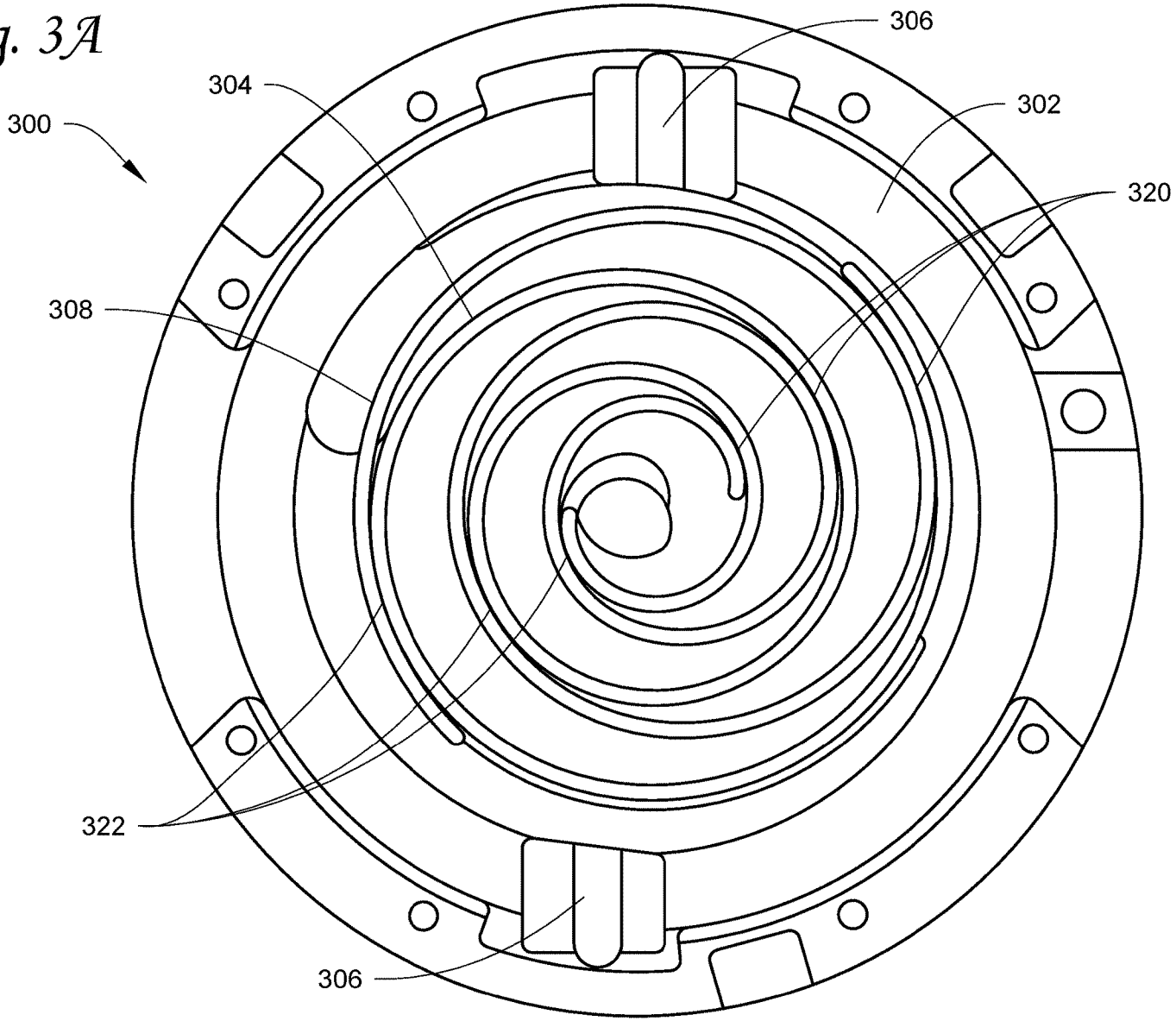
FIGS. 3A-3B show an enlarged view of scroll compressor components according to an embodiment.
Figure 3B:
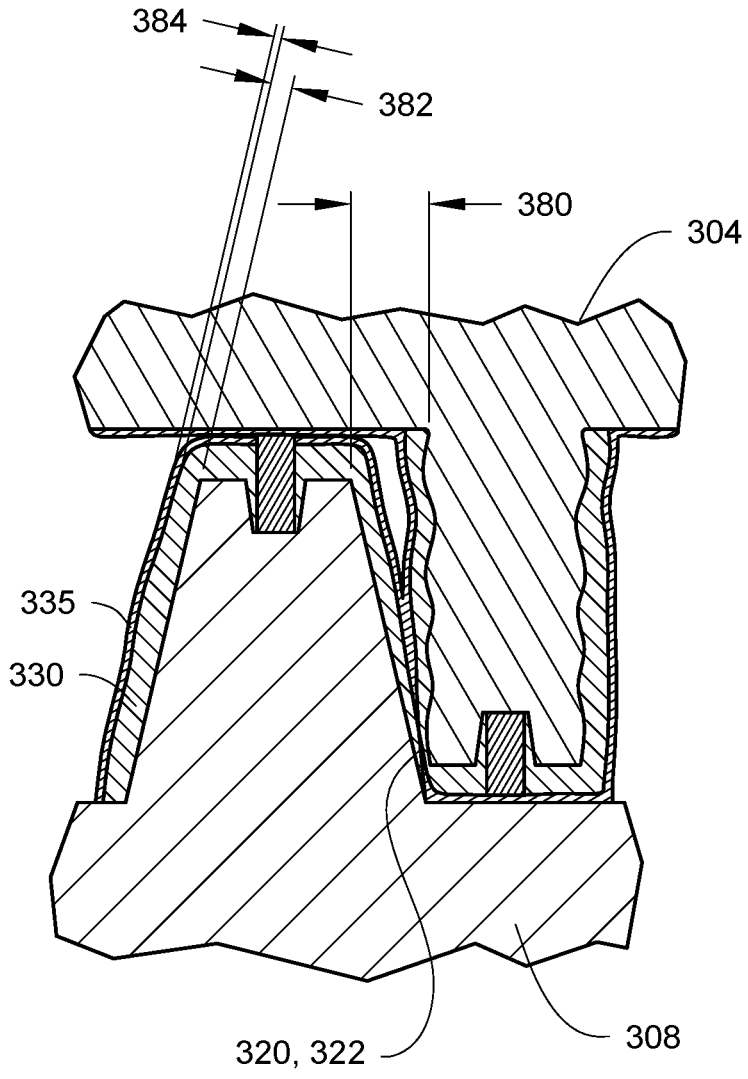

FIGS. 3A and 3B illustrate an example of a fixed scroll 304 and orbiting scroll 308 in a scroll compressor 300 having a coating layer 330 according to an embodiment. The scroll compressor may have the same or similar features as scroll compressor 200 of FIG. 2. The scroll compressor 300 includes face 302. Fixed scroll 304 extends from face 302. In an embodiment, grooves 306 are provided at two positions on face 302. The grooves 306 are openings in the face 302 capable of receiving projections of an Oldham coupling.

The orbiting scroll 308 is designed or otherwise configured to intermesh or mate with the fixed scroll 304 to compress, for example, the working fluid of an HVACR system at meshing locations 320, 322, in which the meshing locations may include the contact points or contact surfaces of the fixed scroll 304 and the orbiting scroll 308. In an embodiment, at the meshing locations 320, 322, the orbiting scroll 308 has a contacting or mating surface that contacts or mates with a contacting or mating surface of the fixed scroll 304 to compress the working fluid, e.g., defines the meshing locations between the orbiting scroll and the fixed scroll from a lower pressure region to a higher pressure region, e.g., for compression. As such, the fixed scroll 304 and the orbiting scroll 308 form together a compression chamber to compress the working fluid.

At the meshing locations 320, 322 of at least one of the orbiting scroll 308 or the fixed scroll 304, a coating layer 330 is provided at least on the contacting or mating surface(s) thereof having a thickness 382. The coating layer may include one or more layers, in which in some embodiments, the coating layer includes at least a first applied layer and a second applied layer that are separate layers, e.g., the layers are not formed or provided as a single layer, but rather are applied in two applications to provide the synergistic benefits as discussed further below. The coating layer(s) may include a conforming material that may include crystals, in which the crystals may include micro-crevices or passages that are designed or otherwise configured to retain or hold lubricant. In some embodiments, the conforming material may include manganese phosphate, fluoropolymer, or similar material. The coating layer may have a thickness 382 between at or about 5 and 50 microns, and in some embodiments, a thickness between at or about 10 and at or about 40 microns or between at or about 10 and at or about 30 microns, or between at or about 10 and at or about 20 microns, or a thickness of at or about 25 microns.

As such, as illustrated in FIG. 3B, the coating layer 330 may be designed or otherwise configured to effectively control the gap distance 380, e.g., by holding the lubricant higher to be the final seal, e.g., by being layered on the coating to span the gap distance to conform to a multitude of geometry variances, such that the lubricant layer 335 has a thickness 384 to seal the gap distance 380 to improve compressor and/or energy efficiency. Thus, even a thin lubricant layer 335 may be held at a distance higher than compressor components not having the coating layer 330, to serve as the final sealing component for even large gap distances 380, such as, gap distances between at or about 5 and at or about 100 microns, or in some embodiments, between at or about 10 and at or about 50 microns, or between at or about 20 and at or about 50 microns, that may be a result machining processes, machining variances, machining tolerances, and/or assembly error or variance. That is, in some embodiments, when the compressor component does not include the coating layer, there may not be proper sealing of a compression chamber at a location of the compression mechanism since the gap distance may be too large, which may result in compression leakage and penalty to energy efficiency.

Figure 4A:
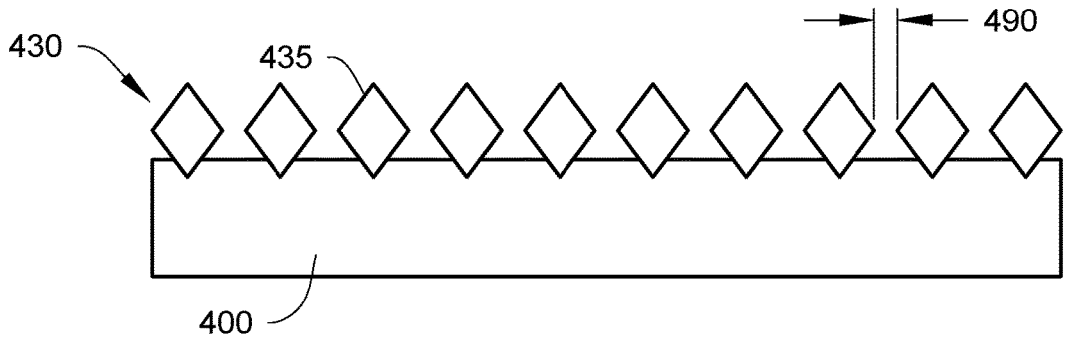
FIGS. 4A, 4B, 4C illustrate schematic views of coating layers according to various embodiments.
Figure 4B:
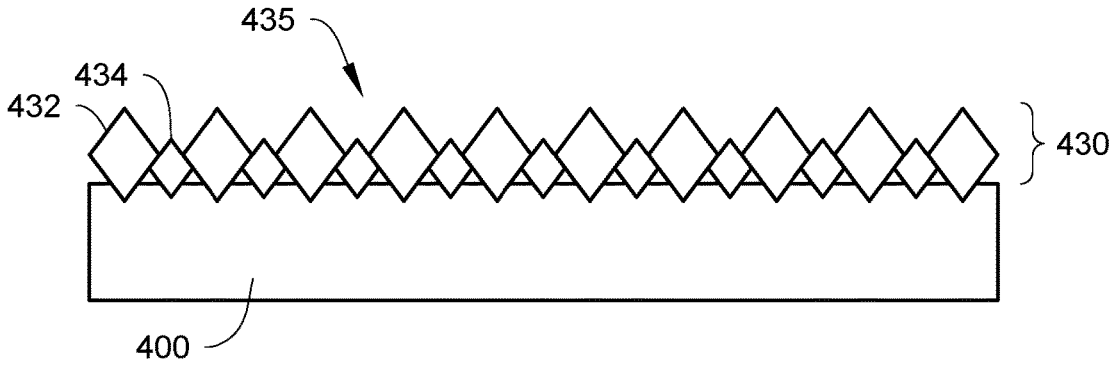
Figure 4C:
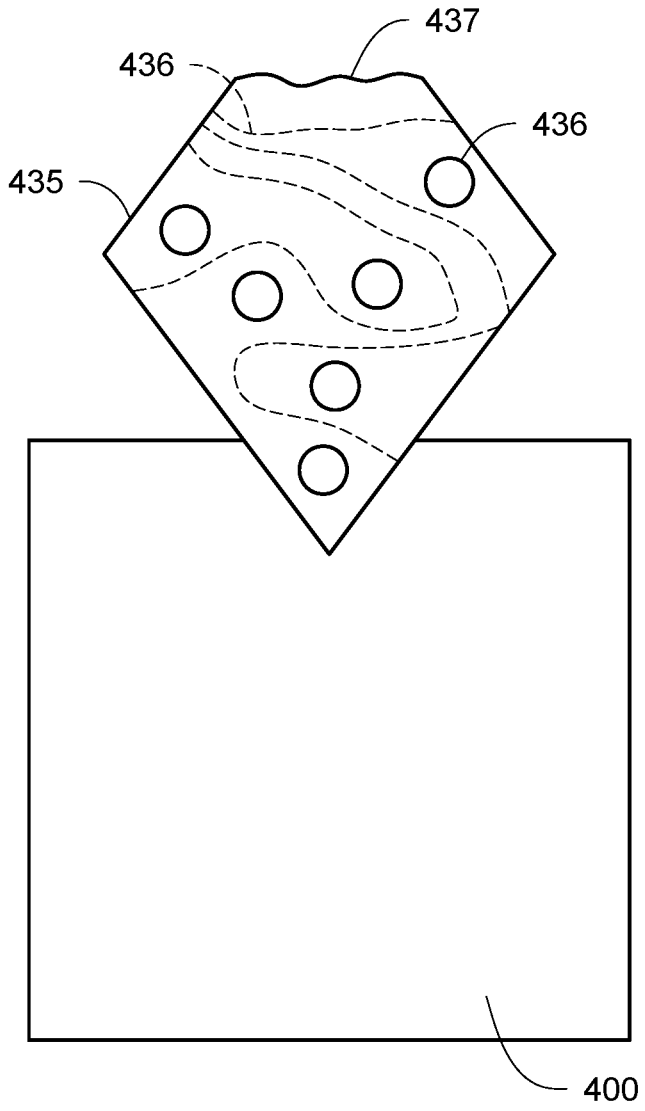

FIGS. 4A, 4B, 4C schematically illustrate an example embodiment of a coating layer 430 on a compressor component 400, such as, fixed scroll 304 of FIG. 3, according to some embodiments. The coating layer 430 may include a conforming material that includes crystals 435 that are formed, coated, grown, deposited, dipped, or otherwise provided on the contact surface of the compressor component 400. In some embodiments, the conforming material may include manganese phosphate or the like.

As illustrated in FIG. 4A, the coating layer 430 may include a single layer having the conforming material. The coating layer 430 may have crystals 435 that may have a crystal or particle size that is between at or about 10 and at or about 40 microns, and in some embodiments, a crystal or particle size of at or about 20 microns. It is appreciated that the conforming material includes crystals that are designed or otherwise configured to hold or retain the lubricant, for example, by including micro-crevices or passages, and/or to be abraded to conform to effectively seal the gap distances of mating components. As such, the coating layer 430 may be provided on at least a portion of the compressor component, e.g., on the contact surfaces thereof, or on the entirety of the compressor component. Since the coating layer 430 includes a conforming material having the crystal or particle size between at or about 10 and at or about 40 microns, it is understood that the coating layer 430 may be abraded to remove at least a portion of the coating layer at local high spots provided between contacting and/or mating surfaces of one or more of the compressor component(s), which may minimize the gap distance between the contacting and/or mating surfaces. That is, since the shape and/or size of the compressor components may vary due to the machining and/or assembly process, the crystals 435 are designed or otherwise configured to break off and/or conform to the compressor component(s) after, for example, an initial pass of the rotating and/or mating compressor component, such that the crystals 435 are provided at a correct height/elevation for the coating layer 430 to elevate the lubricant, e.g., hold the oil to seal the compression chamber at the correct location to seal the gap distance due to the variation in the machining and/or assembly process.

As illustrated in FIGS. 4A and 4B, in some embodiments, the coating layer 430 may include at least a first applied layer 432 and a second applied layer 434 on the contacting surface of the compressor component 400, both of which include a conforming material, which may be the same or different conforming material. In some embodiments, the first applied layer 432 and the second applied layer 434 may be separate layers, e.g., the layers are not formed or provided as a single layer, but rather are applied in two applications on the contacting surface to provide the synergistic benefits as discussed further below. It is appreciated that in some embodiments, in which the crystals 435 have a large crystal or particle size, for example, between at or about 20 and at or about 40 microns, gaps 490 may be present between the crystals 435 such that the working fluid, e.g., refrigerant, may contact the compressor component, e.g., bare metal surfaces, which may result in decreased performance characteristics, such as reduced reliability and/or rusting and/or galling wear of the compressor component. Thus, in some embodiments, the first applied layer 432 and the second applied layer 434 may be provided, in which at least the second applied layer 434 is designed or otherwise configured to seal the gaps 490 between the crystals 435. For example, in some embodiments, the crystal or particle size of the conforming material in the first layer 432 and the second layer 434 may be different.

Referring back to FIG. 4B, in an embodiment, the first applied layer 432 may be initially provided on the contacting surface of the compressor component 400 and then the second applied layer 434 may be provided subsequently, on the contacting surface of the compressor component 400, for example, via a double coating or dipping process. That is, without wishing to be bound by theory, it is understood that the chemical reaction for forming the conforming material, as disclosed herein, may require a metal nucleation site to grow, e.g., to grow the crystals, in which the crystals may not grow on existing crystals. As such, the conforming material of the first applied layer 432 may include crystals or particles that are first formed or applied via a first application process to grow the crystals on the contacting surface, e.g., at metal nucleation sites, and then the second applied layer 434 may include crystals or particles that are subsequently formed or applied via a second application process to grow smaller crystals on the contacting surface, e.g., at metal nucleation sites, e.g., provided via the gaps 490 between the larger crystals 435 from the first applied layer 432, e.g., the bare spots resulting from the formation of the larger crystals during the first application process. That is, the first applied layer 432 may include crystals that have a larger crystal or particle size than the crystal or particle size of the crystals of the conforming material of the second layer 434. For example, in an embodiment, the conforming material of the first layer 432 may have a crystal or particle size between at or about 10 and at or about 40 microns or between at or about 20 and at or about 40 microns or at or about 20 microns and the crystal or particle size of the conforming material of the second layer 434 may be between at or about 1 and at or about 10 microns, or at or about 5 microns.

As illustrated in FIG. 4C, which is an enlarged cross-sectional view of the crystals 435 of FIG. 4B, the conforming material is designed or otherwise configured to hold or retain the lubricant, for example, by including micro-crevices or passages 436, and/or to be abraded or conform to effectively seal the gap distances of mating components, e.g., abraded surface 437. As such, the coating layer 430 may be provided on at least a portion of the compressor component, e.g., on the contact surfaces thereof, or on the entirety of the compressor component. Since the coating layer 430 includes a conforming material having the crystals having various sizes, it is understood that the coating layer 430 may be abraded to remove at least a portion of the coating layer at local high spots provided between coating and/or mating surfaces of one or more of the compressor component(s). That is, since the shape and/or size of the compressor components may vary due to the machining and/or assembly process, the crystals 435 are designed or otherwise configured to break off and/or conform to the gap distance between compressor component(s) after, for example, an initial pass of the rotating and/or mating compressor component, such that the crystals 435 are provided at a correct or required height/elevation for the coating layer 430 to elevate the lubricant, e.g., hold the oil to seal the compression chamber at the correct location and/or to seal the gap distance due to the variations in the machining and/or assembly process.

As such, it was surprisingly found that the combination of at least the first applied layer 432 and the second applied layer 434 having different crystal or particle sizes for the conforming material resulted in a synergistic effect, which was greater than the use of large crystals or smaller crystals alone. For example, the use of large crystals alone in the conforming material may allow the working fluid and/or lubricant to reach bare spots of the compressor components, e.g., metal surfaces, e.g., via gaps 490, while smaller crystals are unable to effectively seal the gap distance resulting from the machining process, for example, since the crystals were too small. The combination of the use of conforming materials with large and small crystal or particle sizes in the first applied layer 432 and the second applied layer 434, however, unexpectedly resulted in a coating layer that was able to not only provide an effective elevation of the lubricant to seal the gap, e.g., minimize gap distance between compressor components, but also seal the compressor component from the working fluid and/or lubricant, e.g., to prevent or mitigate corrosion and/or galling wear. That is, it is understood that in some embodiments, since the crystals of the first applied layer 432 and the second applied layer 434 are both grown on the metal nucleation sites on the contacting surface of the compressor component 400, the amount of bare metal provided between the crystals 435 may be minimized or prevented from being present, in which the distance between the crystals 435 is small and, due in part to the random complexity of the crystals, a leak path to any bare metal on the contacting surface is prevented.

Moreover, while a coating layer being provided on the contact surface of one of the orbiting scroll or the fixed scroll has been discussed, such discussion is not intended to be limiting. For example, in some embodiments, the coating layer 430 may be provided on mating surfaces of both mating compressor components, e.g., fixed scroll and orbiting scroll, for example, in embodiments in which the gap size is between at or about 50 and at or about 100 microns, e.g., gap distances in which a single coating layer may not be able to seal the gap with the lubricant. Thus, since both of the mating compressor components include the coating layer 430, larger gap distances may be compensated for to effectively seal the gap to prevent or mitigate working fluid leakage. Moreover, it is appreciated that the coating layer 430 may be provided on the contact surfaces alone or along various portions or the entirety of the orbiting scroll and/or the fixed scroll of the scroll compressor.

Figure 5:
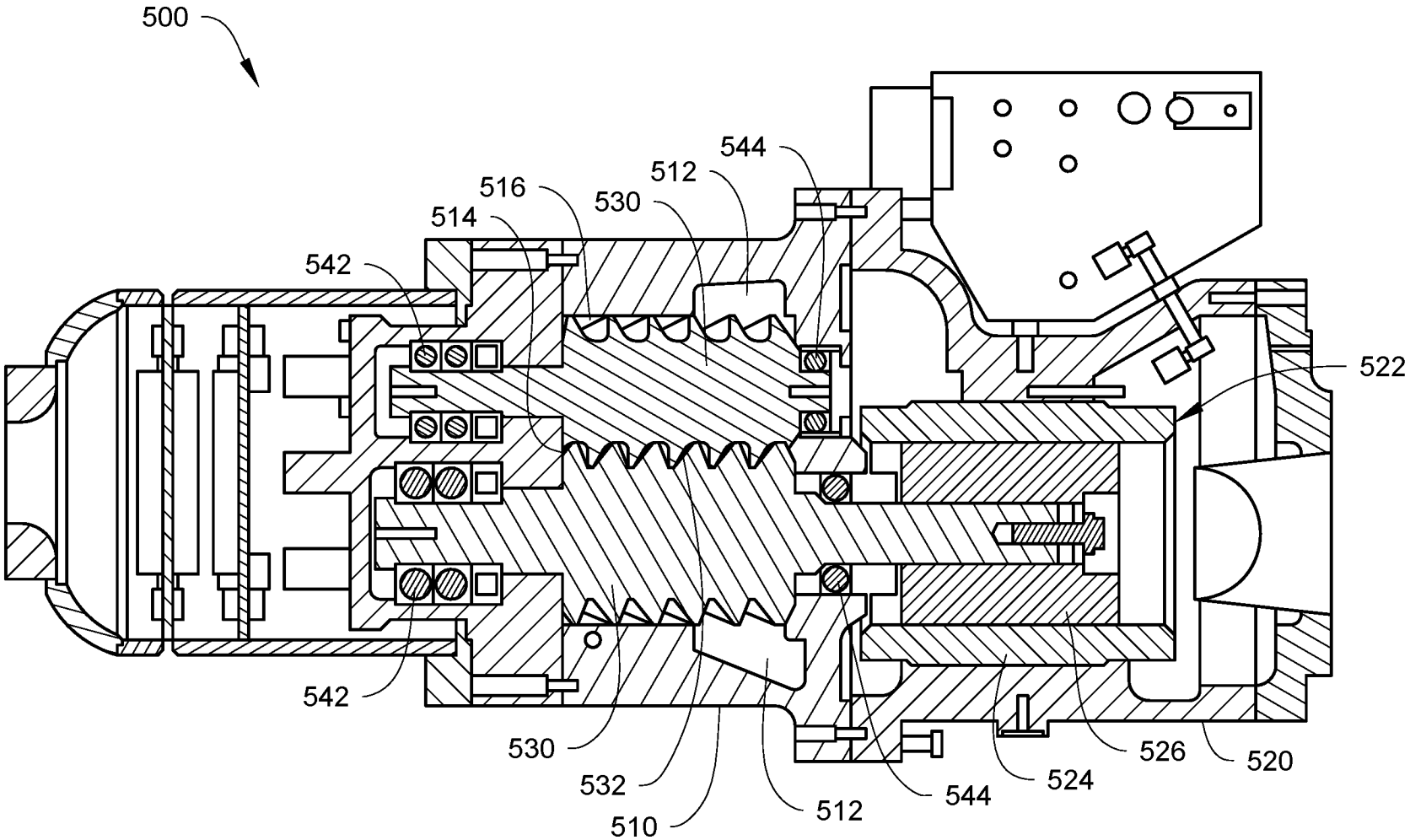
FIG. 5 shows a sectional view of a screw compressor according to an embodiment.

FIG. 5 illustrates an example of a screw compressor 500 in which at least one of the intermeshing screw rotors has a coating layer according to an embodiment. The screw compressor 500 includes a rotor housing 510 and an electric motor housing 520. The electric motor housing 520 includes a motor 522 that may include a motor stator 524 and a motor rotor 526, in which the motor rotor 526 may be the rotating component of the motor 522 and may provide a magnetic field that interacts with the rotating stator magnetic field to produce rotor torque.

The rotor housing 510 may include a low pressure end and a high pressure end that each contain a suction port 512 and a discharge port 514. The screw compressor 500 may receive the working fluid at the suction port 512 into the compression chamber 516 and compress the working fluid as the screw compressor 500 communicates the working fluid from the suction port 512 to the discharge port 514.

In some embodiments, rotors 530 may be mounted for rotation in the rotor housing 510 to form the compression chamber 516. The rotors 530 may be meshed screw rotors that define one or more compression pockets between the rotors 530 and the interior chamber walls of the rotor housing 510. In some embodiments, the rotors 530 may include shaft portions, which are, in turn mounted to the housing of the screw compressor 500 by, for example, one or more bearings 542, 544.

At the intermeshing of the screw rotors that define the one or more compression pockets, one or more of the meshing locations 532 between the rotors 530 may contain a coating layer on the contact surface(s) thereof. The coating layer may include the coating layer 430 as discussed above with respect to FIG. 4B. The coating layer may include one or more layers, in which in some embodiments, the coating layer includes at least a first applied layer and a second applied layer. The coating layer(s) may include a conforming material that includes crystals and may further include manganese phosphate, fluoropolymer, or similar material that may be formed to include micro-crevices or passages that are designed or otherwise configured to retain or hold lubricant. The coating layer may have a thickness between at or about 5 and at or about 50 microns, and in some embodiments, a thickness between at or about 10 and at or about 40 microns or between at or about 10 and at or about 30 microns, or between at or about 10 and at or about 20 microns, or a thickness of at or about 25 microns. As such, the coating layer may be designed or otherwise configured to effectively control the gap distance and/or hold the lubricant higher to seal the gap between rotors 530 to improve compressor and/or energy efficiency. Thus, even a thin layer of the lubricant may be held at a higher distance to serve as the final sealing component for even large gap distances, such as, gap distances between at or about 5 and at or about 100 microns, or in some embodiments, between at or about 10 and at or about 50 microns, or between at or about 20 and at or about 50 microns, that may be a result machining processes, machining variances, machining tolerances, and/or assembly processes.

Figure 6:
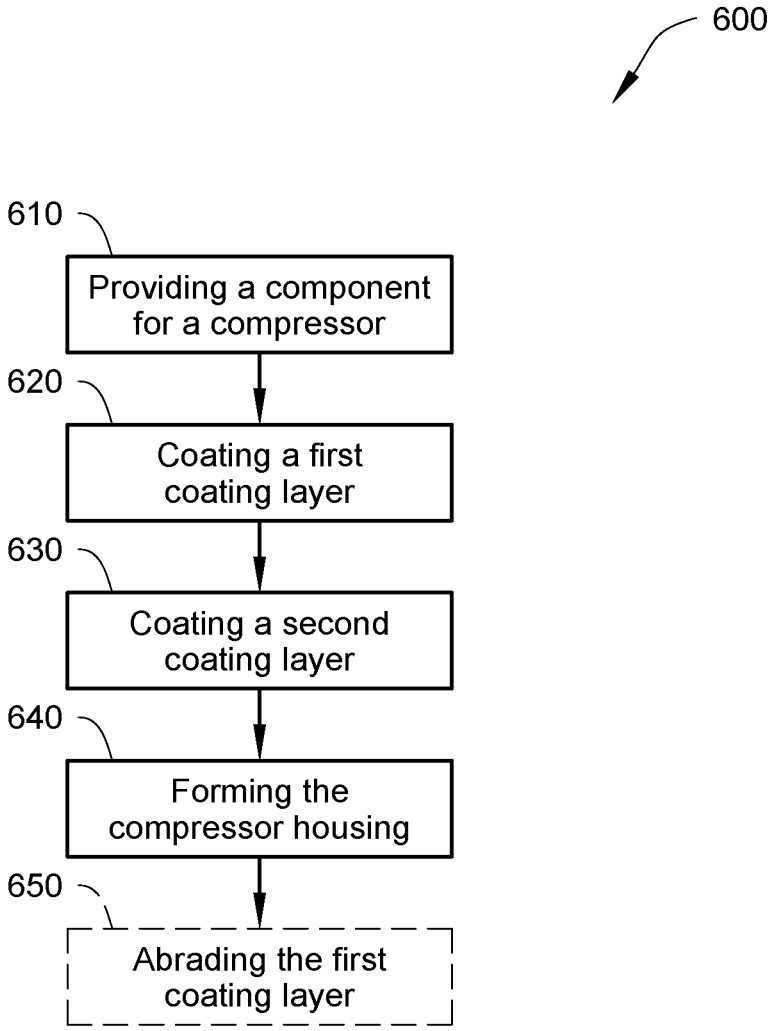
FIG. 6 illustrates an exemplary processing flow for manufacturing a compressor according to an embodiment.

FIG. 6 is a flowchart illustrating a method for manufacturing a positive displacement compressor with a conforming coating according to an embodiment. The positive displacement compressor can be a scroll compressor or screw compressor having at least one rotating part or component. It is to be understood that the processing flow 600 can include one or more operations, actions, or functions as illustrated by one or more of blocks 610, 620, 630, 640, 650. Although illustrated as discrete blocks, obvious modifications may be made, e.g., two or more of the blocks may be re-ordered; further blocks may be added; and various blocks may be divided into additional blocks, combined into fewer blocks, or eliminated, depending on the desired implementation. Processing flow 600 may begin at block 610.

At 610 (Providing a component for a compressor), a component for a positive displacement compressor is provided. In some embodiments, the component may be a rotating component and/or a second component, such as, a fixed component, such as a fixed scroll, labyrinth seal, or other component having a surface that contacts the rotating component in which a lubricant is provided, or both components may be rotating components, such as, male and female rotors of a screw compressor in which lubricant is provided. As discussed further below, for ease of understanding the disclosure, the rotating component may be an orbiting scroll and the second component may be a fixed scroll for a scroll compressor. As such, it is understood that the orbiting scroll and the fixed scroll include one or more contacting surfaces that intermesh to define a meshing location between the orbiting scroll and the fixed scroll to compress, for example, a working fluid of an HVACR system. Processing flow 600 may proceed to block 620.

At 620 (Coating a first coating layer), at least one of the orbiting scroll or the fixed may be coated with a first coating layer. The coating layer may include a conforming material that may be chosen based on chemistry of the working fluid and lubricant, in addition to its mechanical characteristics with the ability to abrade and conform, and the characteristics of being designed or otherwise configured such that lubricant may cling and/or be held by the conforming material such that lubricant forms the final compression seal. For example, in some embodiments, the conforming material may include crystals that may be designed or otherwise configured to hold or retain the lubricant, for example, by including micro-crevices or passages, and/or to be abraded to conform to effectively seal the gap distances of the mating components. In some embodiments, the conforming material may be manganese phosphate or a fluoropolymer, or the like. In some embodiments, the first coating layer may be formed, coated, grown, deposited, dipped, or otherwise provided on at least one contacting surface of the orbiting scroll or the fixed scroll in which the conforming material is grown or deposited as crystals to form the first coating layer, e.g., at a metal nucleation site on the contacting surface. In some embodiments, the morphology of the crystals, such as, length, width, shape, or the like, may be controlled or modified during the coating process to adjust a thickness, height, size, or the like of the crystals and/or the coating layer to reduce and/or mitigate the gap distance between mating and/or sealing surfaces, e.g., of the orbiting scroll and the fixed scroll. In some embodiments, the first coating layer may have crystals that have a crystal or particle size that is between at or about 10 and at or about 40 microns, and in some embodiments, between at or about 10 and at or about 20 microns, and in some embodiments, a crystal or particle size of at or about 20 microns. Processing flow 600 may proceed to block 630.

At 630 (Coating a second coating layer), a second coating layer is coated on the contacting surface of at least one of the orbiting scroll or the fixed scroll. The second coating layer may include a conforming material that may be the same or different than the conforming material of the first coating layer. In some embodiments, the second coating layer may be formed, coated, grown, deposited, dipped, or otherwise provided on the contacting surface of the orbiting scroll or the fixed scroll in which the conforming material is grown or deposited as crystals to form the second coating layer, e.g., at any remaining nucleation site, e.g., bare metal provided between the crystals formed during the coating of the first coating layer. In some embodiments, the morphology of the crystals, such as, length, width, shape, or the like, may be controlled or modified during the coating process to adjust a thickness, height, size, or the like of the crystals and/or the coating layer to further reduce and/or mitigate the gap distance between mating and/or sealing surfaces, e.g., of the orbiting scroll and the fixed scroll. In some embodiments, the second coating layer may have crystals that have a crystal or particle size that is between at or about 1 and at or about 10 microns, and in some embodiments, between at or about 1 and at or about 5 microns, and in some embodiments, a crystal or particle size of at or about 5 microns.

In some embodiments, the crystal or particle size of the conforming material in the first coating layer and in the second coating layer may have different particle sizes. In some embodiments, the conforming material of the first coating layer may include a crystal or particle size that is larger than the crystal or particle size of the conforming material of the second coating layer. For example, in an embodiment, the conforming material of the first coating layer may have a crystal or particle size between at or about 10 and at or about 40 microns or between at or about 20 and at or about 40 microns or at or about 20 microns and the crystal or particle size of the conforming material of the second coating layer may be between at or about 1 and at or about 10 microns, or at or about 5 microns. As such, it was surprisingly found that the combination of at least the first coating layer and the second coating layer having different crystal or particle sizes for the conforming material resulted in a synergistic effect, which was greater than the use of large crystals or smaller crystals alone. For example, the use of large crystals alone in the conforming material may allow the working fluid and/or lubricant to reach bare spots of the compressor components, e.g., metal surfaces, while smaller crystals are unable to effectively seal the gap distance due resulting from the machining process, for example, since the crystals were too small. The combination of the use of conforming materials with large and small crystal or particle sizes in the first coating layer and the second coating layer, however, unexpectedly resulted in a coating layer that was able to not only provide an effective elevation of the lubricant to seal the gap, e.g., minimize gap distance between compressor components, but also seal the compressor component from the working fluid and/or lubricant, e.g., to prevent or mitigate corrosion and/or galling wear, of the fixed scroll and/or orbiting scroll. That is, it is understood that in some embodiments, since the crystals of the first coating layer and the second coating layer are both grown on the metal nucleation sites on the contacting surface of the compressor component 400, the amount of bare metal provided between the crystals may be minimized or prevented from being present, in which the distance between the crystals is small and, due in part to the random complexity of the crystals, a leak path to any bare metal on the contacting surface is prevented.

While a coating layer being provided on the contact surface of one of the orbiting scroll and the fixed scroll has been discussed, such discussion is not intended to be limiting. For example, in some embodiments, the coating layer may be provided on mating surfaces of both mating compressor components, e.g., fixed scroll and orbiting scroll, for example, in embodiments in which the gap size is between at or about 50 and at or about 100 microns, e.g., gap distances in which a single coating layer may not be able to seal the gap with the lubricant. Thus, since both of the mating compressor components include the coating layer, larger gap distances may be compensated for to effectively seal the gap to prevent or mitigate working fluid leakage. Moreover, it is appreciated that the coating layer may be provided on the contact surfaces alone or along various portions or the entirety of the orbiting scroll and/or the fixed scroll of the scroll compressor. Processing flow 600 may proceed to block 640.

At 640 (Forming the compressor housing), the scroll compressor may be assembled in which the scroll compressor housing is formed with the orbiting scroll and the fixed scroll to form the compression chamber for compressing the working fluid. It is appreciated that due in part to machining differences, machining variances, and/or machining tolerances or assembly processes, gaps may be present between the orbiting scroll and the fixed scroll, which may pass some or a portion of the working fluid which reduces the compression efficiency. However, since at least one of the orbiting scroll or the fixed scroll includes the coating layer having at least the first coating layer and the second coating layer, the gap distance between the orbiting scroll and the fixed scroll may be controlled such that the lubricant may be provided to seal the gap to improve compressor and/or energy efficiency, e.g., to minimize or prevent working fluid leakage. Processing flow 600 may optionally proceed to block 650.

At optional block 650 (Abrading the first coating layer and/or the second coating layer), the coating layer may be abraded such that any excess coating layer is broken off or removed, which may minimize the gap distance between the orbiting scroll and the fixed scroll. That is, since the conforming material of the first coating layer may have a crystal or particle size between at or about 10 and at or about 40 microns or between at or about 20 and at or about 40 microns or at or about 20 microns and the crystal or particle size of the conforming material of the second coating layer may be between at or about 1 and at or about 10 microns, or at or about 5 microns, it is understood that the coating layer may be abraded to remove at least a portion of the coating layer at local high spots provided between contacting and/or mating surfaces of one or more of the compressor component(s), e.g., the contact points of the orbiting scroll and the fixed scroll. That is, since the shape and/or size of the compressor components may vary due to the machining and/or assembly process, the crystals are designed or otherwise configured to break off and/or conform to the compressor component(s) after, for example, an initial pass of the orbiting scroll with respect to the fixed scroll, such that the crystals are provided at a correct height/elevation for the coating layer to elevate the lubricant, e.g., hold the oil to seal the compression chamber at the correct location to seal the gap distance due to the variation in the machining process.

Aspects

It is to be appreciated that any of the aspects can be combinable with any other one of the aspects below.

Aspect 1. A positive displacement compressor comprising: a compressor housing; a rotating component disposed within the compressor housing, wherein the rotating component and at least one second component form a compression chamber to compress a working fluid; each of the rotating component and the at least one second component having a contacting surface, the contacting surface of the rotating component and the contacting surface of the at least one second component defining a meshing location between the rotating component and the at least one second component to form the compression chamber; a coating layer provided on the contacting surface of at least one of the rotating component or the at least one second component, wherein the coating layer comprises at least a first applied layer and a second applied layer, wherein the first applied layer and the second applied layer are separate layers and both the first applied layer and the second applied layer include a conforming material, wherein the conforming material in the first applied layer has a different particle size than the conforming material in the second applied layer such that a combination of the first applied layer and the second applied layer seal the contacting surface.

Aspect 2. The positive displacement compressor of Aspect 1, wherein the particle size of the conforming material in the first applied layer is larger than the particle size of the conforming material in the second applied layer.

Aspect 3. The positive displacement compressor of Aspect 2, wherein the particle size of the conforming material in the first applied layer is between at or about 10 and at or about 40 microns and the particle size of the conforming material in the second applied layer is between at or about 1 and at or about 10 microns.

Aspect 4. The positive displacement compressor of Aspect 3, wherein the particle size of the conforming material in the first applied layer is at or about 20 microns and the particle size of the conforming material in the second applied layer is at or about 5 microns.

Aspect 5. The positive displacement compressor of any of Aspects 1-4, wherein the conforming material of the first applied layer and the conforming material of the second applied layer include crystal particles formed on the contacting surface to seal the contacting surface.

Aspect 6. The positive displacement compressor of Aspect 5, wherein, the crystal particles have micro crevices to retain oil.

Aspect 7. The positive displacement compressor of any of Aspects 1-6, wherein the conforming material is manganese phosphate.

Aspect 8. The positive displacement compressor of any of Aspects 1-7, wherein the positive displacement compressor is a scroll compressor or a screw compressor.

Aspect 9. A heating, ventilation, air conditioning, and refrigeration (HVACR) system, comprising: a compressor; a condenser; an expander; and an evaporator, wherein the compressor comprises: a compressor housing; a rotating component disposed within the compressor housing, wherein the rotating component and at least one second component form a compression chamber to compress a working fluid; each of the rotating component and the at least one second component having a mating surface, the mating surface of the rotating component and the mating surface of the at least one second component defining a meshing location between the rotating component and the at least one second component to form the compression chamber; a coating layer provided on the mating surface of at least one of the rotating component or the at least one second component, wherein the coating layer comprises at least a first applied layer and a second applied layer, wherein the first applied layer and the second applied layer are separate layers and both the first applied layer and the second applied layer include a conforming material, wherein the conforming material in the first applied layer has a different particle size than the conforming material in the second applied layer such that a combination of the first applied layer and the second applied layer seal the contacting surface.

Aspect 10. The HVACR system of Aspect 9, wherein the particle size of the conforming material in the first applied layer is larger than the particle size of the conforming material in the applied second layer.

Aspect 11. The HVACR system of Aspect 10, wherein the particle size of the conforming material in the first applied layer is between at or about 10 and at or about 40 microns and the particle size of the conforming material in the second applied layer is between at or about 1 and at or about 10 microns.

Aspect 12. The HVACR system of Aspect 11, wherein the particle size of the conforming material in the first applied layer is at or about 20 microns and the particle size of the conforming material in the second applied layer is at or about 5 microns.

Aspect 13. The HVACR system of any of Aspects 9-12, wherein the conforming material of the first applied layer and the conforming material of the second applied layer include crystal particles formed on the contacting surface to seal the contacting surface.

Aspect 14. The HVACR system of any of Aspects 9-12, wherein the conforming material is manganese phosphate.

Aspect 15. A method of manufacturing a positive displacement compressor with a conforming material on at least one contacting surface, comprising: providing at least one rotating component or a second component that forms a compression chamber in a compressor housing for the positive displacement compressor, each of the rotating component or second component having a contacting surface, the contacting surface of the rotating component and the contacting surface of the second component defining a meshing location between the rotating component and the second component to form the compression chamber; coating a first coating layer on the contacting surface of at least one of the rotating component and the second component; coating a second coating layer on the contacting surface of the at least one of the rotating component or the second component, wherein both the first coating layer and the second coating layer include a conforming material, wherein the conforming material in the first coating layer has a different particle size than the conforming material in the second coating layer; and forming the compressor housing including the rotating component and the second component within the compressor housing, wherein the at least one rotating component or the second component that form the compression chamber includes the first coating layer and the second coating layer such that a combination of the first coating layer and the second coating layer seal the contacting surface, wherein the first coating layer and the second coating layer are separate t layers.

Aspect 16. The method of Aspect 15, wherein the coating the first coating layer and the second coating layer includes a double dipping process, wherein the first coating layer is provided during a first dipping process and the second coating layer is subsequently provided in a second dipping process.

Aspect 17. The method of any of Aspects 15-16, wherein the conforming material is manganese phosphate.

Aspect 18. The method of any of Aspects 15-17, wherein the particle size of the conforming material in the first coating layer is larger than the particle size of the conforming material in the second coating layer.

Aspect 19. The method of any of Aspects 15-18, further comprising abrading the first coating layer to minimize a gap distance between the contacting surface of the rotating component and the contacting surface of the at least one second component.

The terminology used in this specification is intended to describe particular embodiments and is not intended to be limiting. The terms "a," "an," and "the" include plural forms as well, unless clearly indicated otherwise. The terms "comprises" and/or "comprising," when used, indicated the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts, without departing from the scope of the present disclosure. The word "embodiment" may, but does not necessarily, refer to the same embodiment. The embodiments and disclosure are examples only. Other and further embodiments may be devised without departing from the basic scope thereof, with the true scope and spirit of the disclosure being indicated by the claims that follow.

What is claimed is:

1. A positive displacement compressor comprising:

a compressor housing;

a rotating component disposed within the compressor housing, wherein the rotating component and at least one second component form a compression chamber to compress a working fluid;

each of the rotating component and the at least one second component having a contacting surface, the contacting surface of the rotating component and the contacting surface of the at least one second component defining a meshing location between the rotating component and the at least one second component to form the compression chamber;

a coating layer provided on the contacting surface of at least one of the rotating component or the at least one second component, wherein the coating layer comprises at least a first applied layer and a second applied layer, wherein the first applied layer and the second applied layer are separate layers and both the first applied layer and the second applied layer include a conforming material, wherein the conforming material in the first applied layer has a different particle size than the conforming material in the second applied layer such that a combination of the first applied layer and the second applied layer seal the contacting surface.

2. The positive displacement compressor of claim 1, wherein the particle size of the conforming material in the first applied layer is larger than the particle size of the conforming material in the second applied layer.

3. The positive displacement compressor of claim 2, wherein the particle size of the conforming material in the first applied layer is between at or about 10 and at or about 40 microns and the particle size of the conforming material in the second applied layer is between at or about 1 and at or about 10 microns.

4. The positive displacement compressor of claim 3, wherein the particle size of the conforming material in the first applied layer is at or about 20 microns and the particle size of the conforming material in the second applied layer is at or about 5 microns.

5. The positive displacement compressor of claim 1, wherein the conforming material of the first applied layer and the conforming material of the second applied layer include crystal particles formed on the contacting surface to seal the contacting surface.

6. The positive displacement compressor of claim 5, wherein, the crystal particles have micro crevices to retain oil.

7. The positive displacement compressor of claim 1, wherein the conforming material is manganese phosphate.

8. The positive displacement compressor of claim 1, wherein the positive displacement compressor is a scroll compressor or a screw compressor.

9. A heating, ventilation, air conditioning, and refrigeration (HVACR) system, comprising:

a compressor; a condenser; an expander; and an evaporator, wherein the compressor comprises:

a compressor housing;

a rotating component disposed within the compressor housing, wherein the rotating component and at least one second component form a compression chamber to compress a working fluid;

each of the rotating component and the at least one second component having a mating surface, the mating surface of the rotating component and the mating surface of the at least one second component defining a meshing location between the rotating component and the at least one second component to form the compression chamber;

a coating layer provided on the mating surface of at least one of the rotating component or the at least one second component, wherein the coating layer comprises at least a first applied layer and a second applied layer, wherein the first applied layer and the second applied layer are separate layers and both the first applied layer and the second applied layer include a conforming material, wherein the conforming material in the first applied layer has a different particle size than the conforming material in the second applied layer such that a combination of the first applied layer and the second applied layer seal the mating surface.

10. The HVACR system of claim 9, wherein the particle size of the conforming material in the first applied layer is larger than the particle size of the conforming material in the applied second layer.

11. The HVACR system of claim 10, wherein the particle size of the conforming material in the first applied layer is between at or about 10 and at or about 40 microns and the particle size of the conforming material in the second applied layer is between at or about 1 and at or about 10 microns.

12. The HVACR system of claim 11, wherein the particle size of the conforming material in the first applied layer is at or about 20 microns and the particle size of the conforming material in the second applied layer is at or about 5 microns.

13. The HVACR system of claim 9, wherein the conforming material of the first applied layer and the conforming material of the second applied layer include crystal particles formed on the mating surface to seal the mating surface.

14. The HVACR system of claim 9, wherein the conforming material is manganese phosphate.

15. A method of manufacturing a positive displacement compressor with a conforming material on at least one contacting surface, comprising:

providing at least one rotating component or a second component that forms a compression chamber in a compressor housing for the positive displacement compressor, each of the rotating component or second component having a contacting surface, the contacting surface of the rotating component and the contacting surface of the second component defining a meshing location between the rotating component and the second component to form the compression chamber;

coating a first coating layer on the contacting surface of at least one of the rotating component or the second component;

coating a second coating layer on the contacting surface of the at least one of the rotating component or the second component, wherein both the first coating layer and the second coating layer include a conforming material, wherein the conforming material in the first coating layer has a different particle size than the conforming material in the second coating layer; and forming the compressor housing including the rotating component and the second component within the compressor housing, wherein the at least one rotating component or the second component that form the compression chamber includes the first coating layer and the second coating layer such that a combination of the first coating layer and the second coating layer seal the contacting surface, wherein the first coating layer and the second coating layer are separate layers.

16. The method of claim 15, wherein the coating the first coating layer and the second coating layer includes a double dipping process, wherein the first coating layer is provided during a first dipping process and the second coating layer is subsequently provided in a second dipping process.

17. The method of claim 15, wherein the conforming material is manganese phosphate.

18. The method of claim 15, wherein the particle size of the conforming material in the first coating layer is larger than the particle size of the conforming material in the second coating layer.

19. The method of claim 15, further comprising abrading the first coating layer to minimize a gap distance between the contacting surface of the rotating component and the contacting surface of the at least one second component.

* * * * *